United States Patent [19]

Ushiyama et al.

[11] Patent Number: 5,023,621

[45] Date of Patent: Jun. 11, 1991

[54] SMALL ANTENNA

[75] Inventors: Katsumi Ushiyama; Sadafumi Sakamoto, both of Tokyo, Japan; Kiyohiko Itoh, 1-10, Minami 5-jo, Nishi 16-chome, Chuo-ku, Sapporo-shi, Hokkaido, Japan

[73] Assignees: Kokusai Electric Co., Ltd., Tokyo; Kiyohiko Itoh, Hokkaido, both of Japan

[21] Appl. No.: 321,626

[22] Filed: Mar. 9, 1989

[30] Foreign Application Priority Data

Mar. 28, 1988 [JP] Japan ..... 63-75352

[51] Int. Cl.[5] ..... H01Q 1/24

[52] U.S. Cl. ..... 343/702; 343/741; 343/857; 455/89; 455/269

[58] Field of Search ..... 343/702, 700 MS, 873, 343/829, 846, 857, 741, 743; 455/277, 344, 347, 351, 269

[56] References Cited

U.S. PATENT DOCUMENTS

| | | | |
|---|---|---|---|
| 3,736,591 | 5/1973 | Rennels et al. | 343/702 |
| 4,053,895 | 10/1977 | Malagisi | 343/700 MS |
| 4,367,474 | 1/1983 | Schaubert et al. | 343/700 MS |
| 4,379,296 | 4/1983 | Farrar et al. | 343/700 MS |
| 4,538,153 | 8/1985 | Taga | 343/700 MS |
| 4,625,212 | 11/1986 | Oda et al. | 343/702 |

FOREIGN PATENT DOCUMENTS

| | | | |
|---|---|---|---|
| 3150235 | 6/1983 | Fed. Rep. of Germany MS | 343/700 |
| 141006 | 8/1983 | Japan | 343/700 MS |
| 7204 | 1/1985 | Japan | 343/702 |

*Primary Examiner*—Michael C. Wimer

*Attorney, Agent, or Firm*—David O'Reilly

[57] ABSTRACT

A small antenna for portable radios and the like in which two planar conductive boards are disposed in parallel relationship at a spaced interval which is small when compared with received radio wavelengths. A dielectric frame is disposed between the two planar conductive boards keeping them at the preselected spaced interval. Arbitrary feeding points are selected along the edges of the two conductive boards and at least one conductor is positioned at an arbitrary selected feeding point to short-circuit the two conductive boards. In some cases a plurality of arbitrary feeding points may be selected along the edges of the two conductive boards and a plurality of conductors positioned at the plurality of arbitary selected feeding points which short-circuits the conductive boards. The positions of the plurality of conductors which short-circuit the conductive boards may be automatically changed at will to provide the most desirable condition responsive to the direction of the radio waves.

5 Claims, 4 Drawing Sheets

SMALL ANTENNA

FIELD OF THE INVENTION

This invention relates to a small antenna for use with a portable small radio apparatus or the like.

BACKGROUND OF THE INVENTION

In the past it has been well known to provide a loop antenna consisting of a wire rod or loop antenna consisting of a metal strip inside a casing of a radio apparatus or the like.

These small antennas, however, have low radiation resistance, and so have extremely low efficiency, and the directivity of these loop antennas depends upon the shape of the loop antenna. Still more, the gain of the loop antenna depends upon the area of the loop, which is under the limitation of the shape or size of the casing, so that it is difficult to make a radio apparatus more portable and smaller without reducing the gain of the antenna.

BRIEF DESCRIPTION OF THE INVENTION

This invention has been made with a view to overcoming the problems involved with loop antennas used for the portable radio apparatus presently available.

This invention, therefore, has as its principal object the provision of a novel loop antenna consisting of two rectangular parallel boards with side frames which is small, thin and light in weight.

It is another object of this invention to provide a small antenna whose efficiency is better than heretofore available.

It is a further object of this invention to provide a small antenna which can provide a selected directivity characteristic.

According to the invention, the small antenna is comprised of two planar rectangular conductive boards in parallel, dielectric frame provided between two feedIng points on the conduction boards along all the four edges at arbitrary positions along one edge of the two conductive boards and at least one conductor which short-circuits the two conductive boards.

The conductive boards and the dielectric frames comprise the casing of a radio apparatus itself as well as the small loop antenna, consequently this small antenna has improved efficiency and better directivity characteristics than a conventional loop antenna provided inside the casing of the radio apparatus. Further, by changing the position of the conductor which short-circuits the two conductive boards, it is possible to change the directivity characteristic. Still the gain of the loop antenna of the invention is higher than that of a conventional antenna.

Other objects advantages and novel features of the invention will become more apparent from the following detailed description of the invention in conjunction with the accompanying drawings in which:

DETAILED DESCRIPTION OF THE INVENTION

Preferred embodiments of this invention will now be described with reference to the accompanying drawings.

Figure 1:
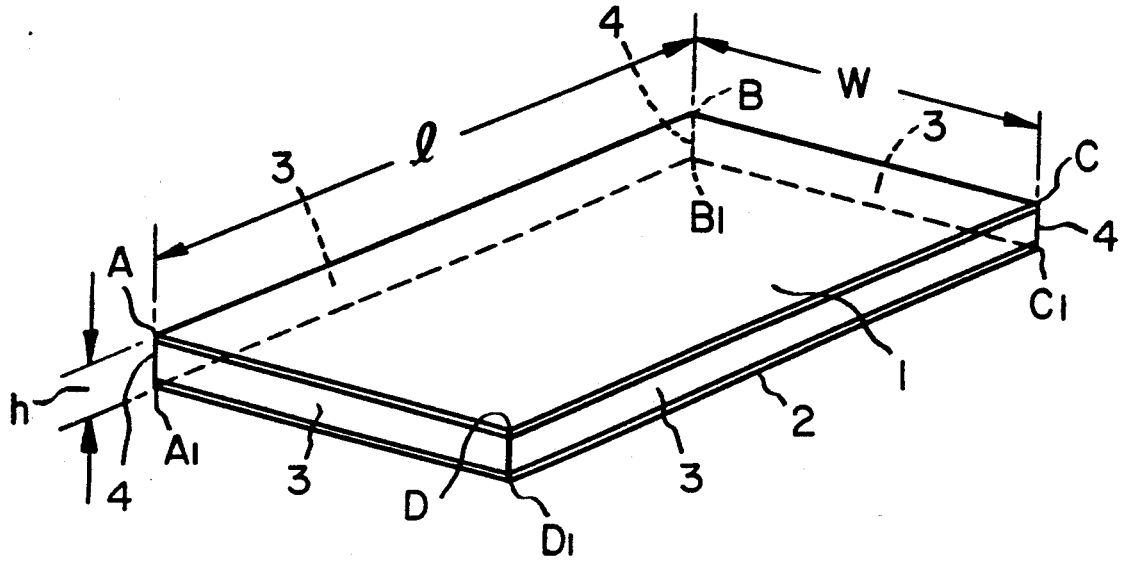
FIG. 1 is a perspective view of a preferred embodiment of the invention.

A first form of a small antenna according to this invention is illustrated in FIG. 1.

The small antenna in this embodiment has two planar rectangular conductive boards I and 2 disposed in parallel at an interval h which is selected to be small when compared with the wavelength of the working radio wave. Dielectric frame 3 is disposed between and around all opposite edges of conductive boards 1, 2 and the entire conductive boards 1, 2 and 4 dielectric frame pieces, 3 comprise a casing for a radio apparatus itself.

The casing of this embodiment is a rectangular parallelipiped having a length $l=80$ mm, a width $w=50$ mm, and a heigth (the interval between the two boards) $h=3.6$ mm. Inside this casing are functional circuits for a radio apparatus.

At an arbitrary position in one of the edges of rectangular conductive boards i and 2 there is a feeding point, which in this embodiment is a corner $D$-$D_1$.

At least one conductor 4 positioned between arbitrary positions along the edges of the two conductive boards I and 2 short circuit the two conductive boards I and 2. In this embodiment, conductors 4 may be provided at one or more selected corners A, $A_1$; B, $B_1$; and C, $C_1$.

Conductive board I and 2 disposed in parallel act as a loop antenna by the existence of conductors 4 which shortcircuit the two conductive boards.

The dimensions 1, w and h and the position of the feeding point (for example D and $D_1$ in the first embodiment) and positions of the short-circuit points are determined by the desired characteristics of the antenna and by data experience, with the final decision being made by experimentation. Interval h between conductive boards i and 2 have an influence upon the gain of the antenna, and so long as the value h is sufficiently small when compared with the wavelength of a working radio wave, the antenna gain can be made higher with the value h. Accordingly the dimensions 1, w and h, the position of the feeding point and the positions for short circuit are decided taking into account the above mentioned matter.

Figure 2A:
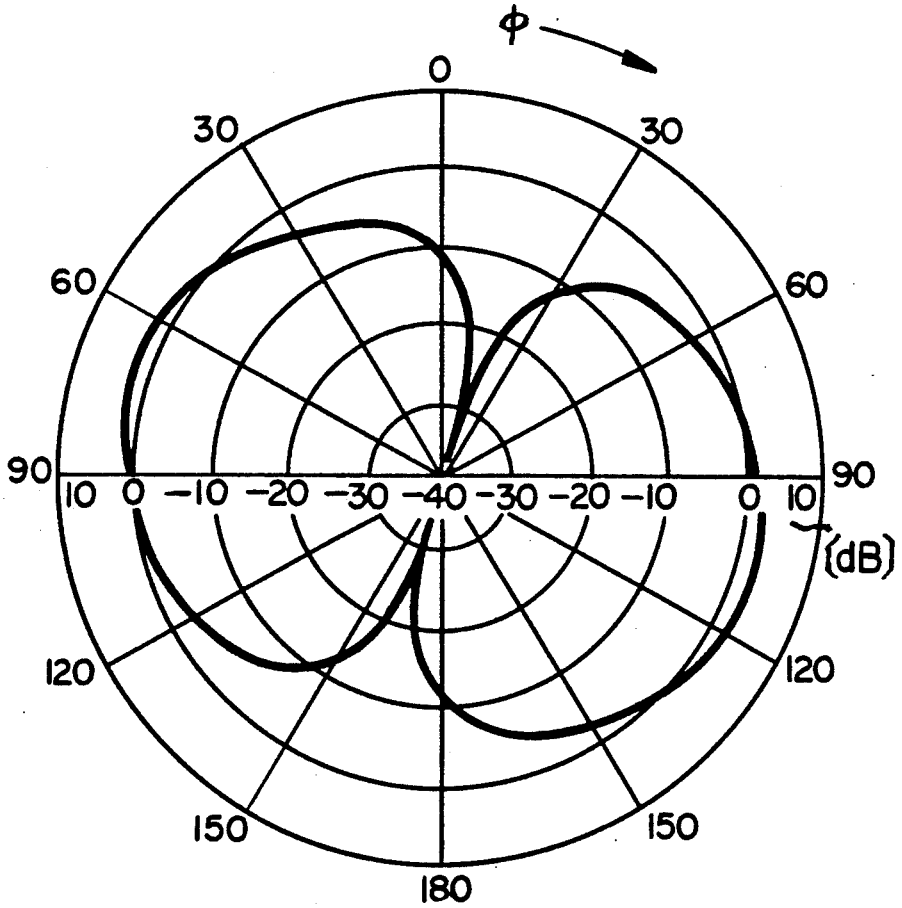
FIGS. 2*a*, 2*b*, and 2*c* are graphs showing the direct characteristic of an antenna constructed according to the invention.
Figure 2B:
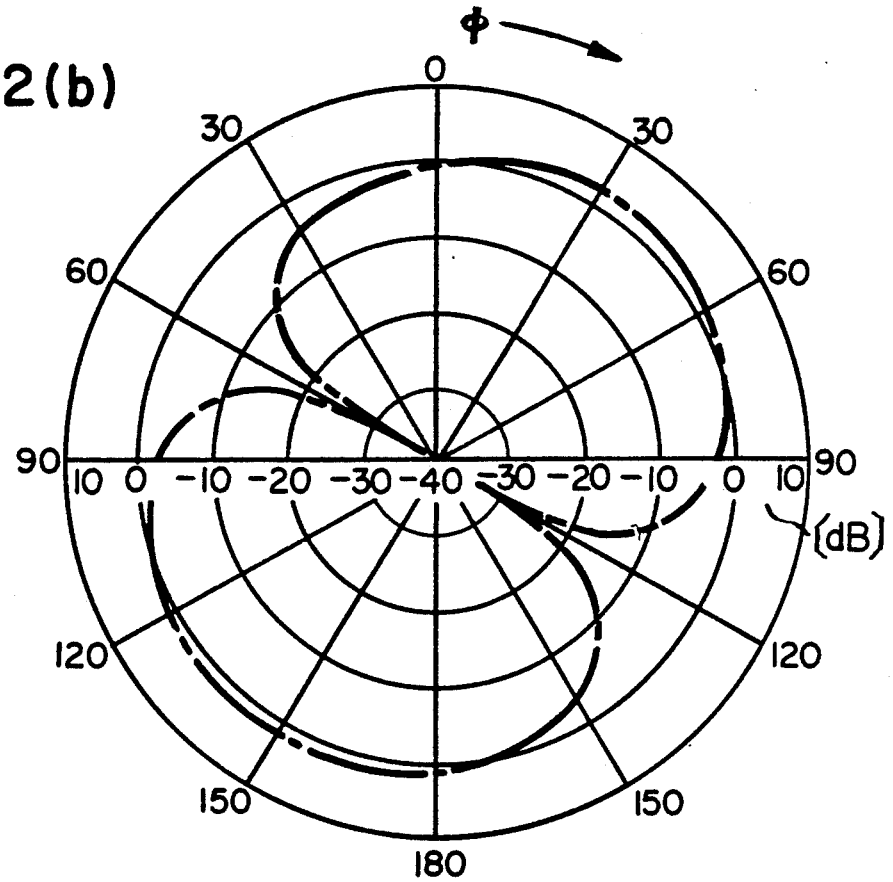
Figure 2C:
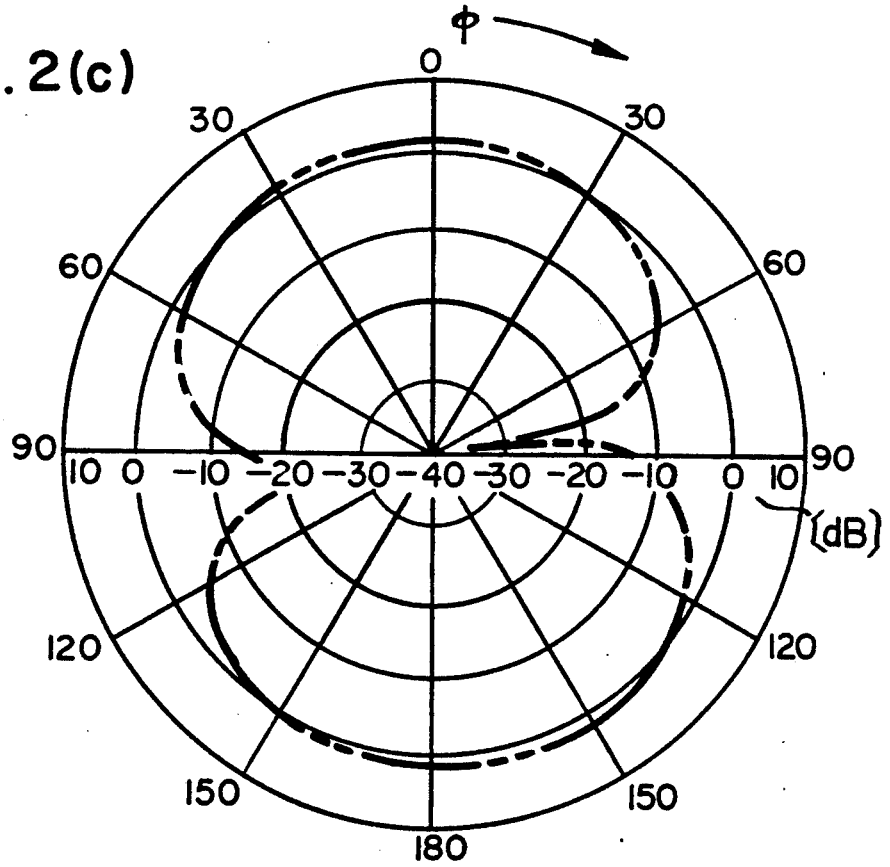
Figure 3:
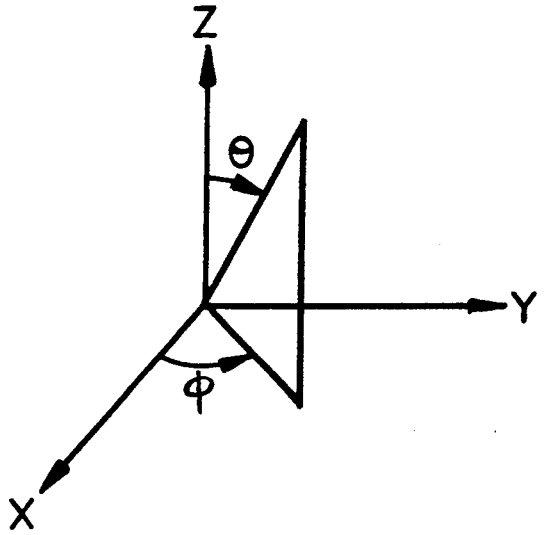
FIG. 3 is a chart illustrating spherical coordinates to explain the polarization directivity characteristic.

FIG. 2(*a*) shows the polarized directivity characteristics of the electrical field along the z axis when one corner angle $D$-$D_1$ is a feeding point and a conductor 4 short-circuits corner angles $A$-$A_1$. FIG. 2(*b*) shows the characteristics when $D$-$D_1$ is a feeding point and the conductor 4 provides a short-circuit between corner angles $B$-$B_1$. And FIG. 2(*c*) shows the characteristics when $D$-$D_1$ is a feeding point and a conductor 4 is provided to short-circuit still another corner angle $C$-$C_1$. The symbol $\phi$ denotes the angle from the X axis (see FIG. 8). It is apparent from FIG. 2 that if the short-circuit position of conductive boards i and 2 disposed in parallel is changed at will, it is possible to change the polarization directivity characteristic of the electric field and, if the short-circuit position is changed automatically, it is possible to keep the directivity of the antenna at the most desirable condition responsive to the direction of a radio wave.

Figure 4:
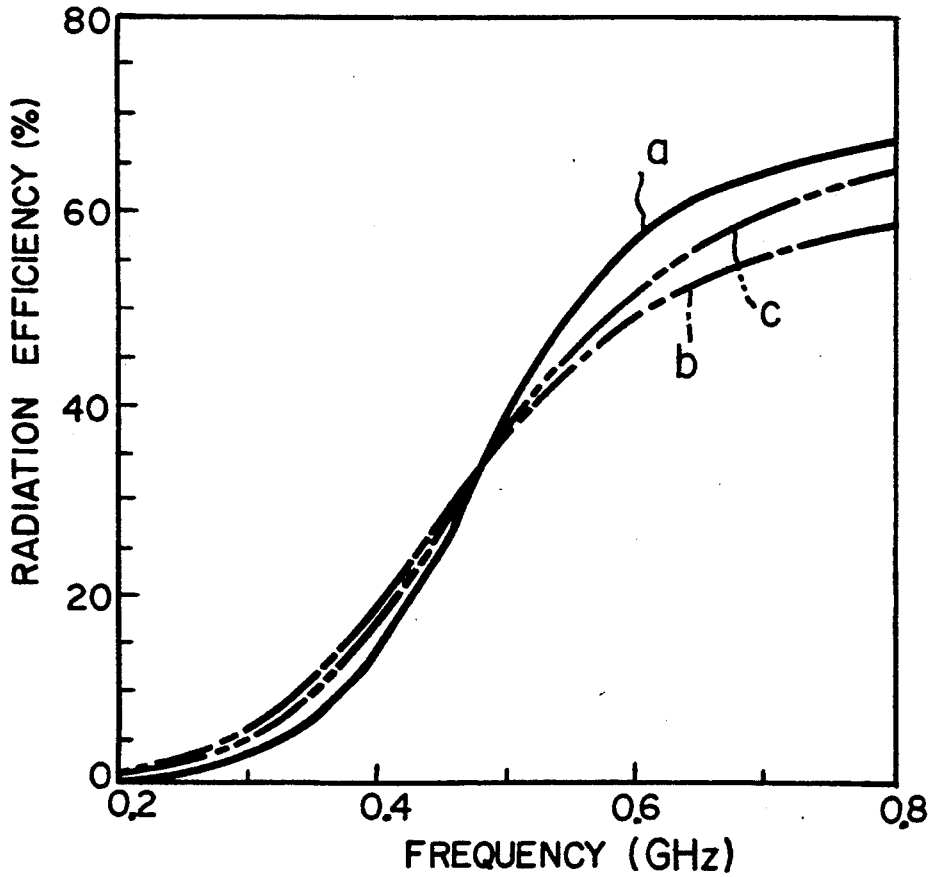
FIG. 4 is a graph showing the frequency dependence of radiation efficiency.

FIG. 4(*a*)–(*c*) shows the frequency dependence of radiation efficiency, when two points A, $A_1$; B, $B_1$: or C, $C_1$, respectfully are short-circuited. A resonant frequency is not changed when A, $A_1$, B, $B_1$, C, $C_1$, or any other points are short-circuited, and radiation efficiencY is independent of the short-circuit position.

Figure 5A:
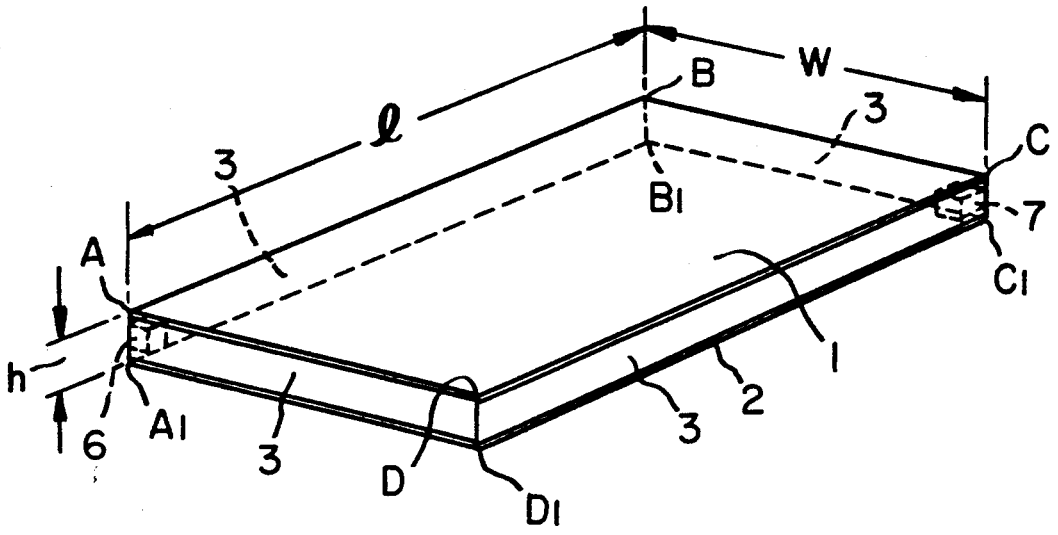
FIG. 5*a* and 5*b* illustrate the automatic switching of short circuit positions.
Figure 5B:
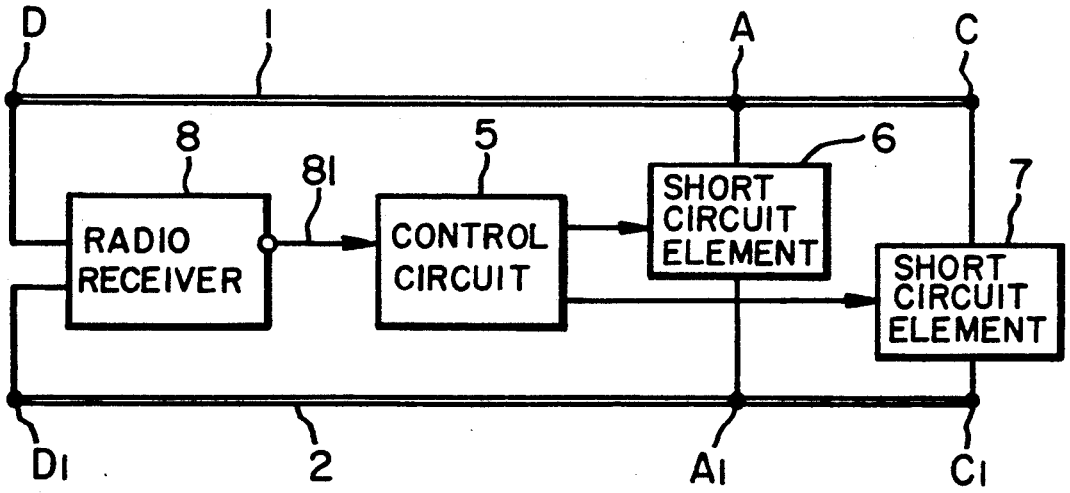

FIGS. 5*a* and 5*b* illustrate short circuit positions changed automatically by switching. In FIGS. 5 *a* and 5*b* elements 6, 7, such as pin diodes or capacitance variable diodes for short circuiting at high frequencies, short circuit corner angles A-$A_1$, C-$C_1$ respectively. Radio receiver 8 provides a field strength detecting circuit (Receiving Signal Strength Indicator) which receives a signal from feeding points D-$D_1$ and generates an output signal at 81. Control circuit 5 successively short circuits short circuit elements 6, 7 and compares output signal 81 and selects the particular position short circuit elements 6, 7 that provide the maximum signal value at 81.

Actual measurements have confirmed that the present embodiment of the invention illustrated in FIG. 1 provides high efficiency as good as or better than the radio apparatus antennas of prior art.

Having described a specific embodiment having short-circuit points at A, $A_1$; B, $B_1$, or C, $C_1$ to make it easy to understand it has been confirmed that the same effect is, as above achieved, when any other points are the short-circuit points and even when several points are simultaneous short-circuit points, or conductor 4 is a metal strip having a certain width.

This invention is not to be limited by the embodiment shown in the drawings and described in the description which is given by way of example and not of limitation, but only in accordance with the scope of the appended claims.

What is claimed is:

1. A small antenna construction for portable radio or the like comprising;

a pair of planar conductive boards disposed parallel to each other;

a dielectric insert spacing means positioned between and spacing said planar conductive boards at a distance from each other that is less than the wavelength of the signals selected to be received;

said planar conductive boards providing a plurality of arbitrarily selected connecting points on their respective edges for connecting feed conducting means and short circuits conducting means;

means to selectively change said arbitrarily selected connecting points in response to the directivity characteristic of the received radio wave;

said means to selectively change said arbitrarily selected connecting points comprising; a plurality of conductors connected to a plurality of arbitrarily selected connecting points, electronic means connected to each of said conductors said electronic means constructed to automatically switch between selected connecting points to change the polarization characteristic of said small antenna for the best reception;

said electronic means comprising; circuit elements selected from the group of a PIN diode and a variable capacitance diode connected to each of said plurality of conductors, a radio receiver having a field strength detecting circuit, a control circuit connected between said radio receiver and said circuit elements for automatically selecting the particular short circuiting position that provides optimum reception and output from said radio receiver, said electronic means including means comparing the output signals from said radio receiver and switching to the short circuiting position that has the best reception;

said short circuit conducting means comprising at least one conductor connecting said planar conductive boards at said arbitrarily selected connecting points on their respective edges;

whereby the polarized directivity characteristics of said antenna for said radio or the like may be changed by changing the position of said at least one conductor.

2. The small antenna according to claim 1 wherein said dielectric insert spacing means is disposed around the edges of said planar conductive boards whereby said dielectric insert and said conductive boards form an enclosure for a radio circuit.

3. The small antenna according to claim 1 wherein said planar conductive boards are approximately equal in size.

4. The small antenna according to claim 3, wherein said planar conductive boards are rectangular; said arbitrarily selected connecting points being selected at opposing respective corner points of said planar conductive boards.

5. The small antenna according to claim 4 wherein said dielectric insert spacing means is disposed around the edges of said planar conductive boards whereby said dielectric insert and said conductive boards form an enclosure for a radio circuit.

* * * * *